US005463947A

United States Patent [19]

Taira

[11] Patent Number: 5,463,947

[45] Date of Patent: Nov. 7, 1995

[54] PLATE FOR STENCIL PRINTING

[75] Inventor: Hiroshi Taira, Ichinomiya, Japan

[73] Assignee: Brother Kogyo Kabushiki Kaisha, Nagoya, Japan

[21] Appl. No.: 271,722

[22] Filed: Jul. 7, 1994

[30] Foreign Application Priority Data

Jul. 15, 1993 [JP] Japan ..... 5-175417

[51] Int. Cl.[6] ..... B41N 1/24

[52] U.S. Cl. ..... 101/125; 101/128.21; 101/128.1

[58] Field of Search ..... 101/125, 128.21, 101/127, 128.1, 128.4, 333, 112, 108

[56] References Cited

U.S. PATENT DOCUMENTS

| | | | |
|---|---|---|---|
| 1,582,004 | 4/1926 | Griggs . | |
| 2,415,704 | 2/1947 | O'Gorman . | |
| 3,270,666 | 9/1966 | Breverman . | |
| 4,123,581 | 10/1978 | Davis et al. | 101/128.2 |
| 4,128,057 | 12/1978 | Hayama et al. | 101/128.2 |
| 4,961,377 | 10/1990 | Bando et al. | 101/128.21 |
| 5,222,431 | 6/1993 | Kawahara | 101/128.21 |
| 5,253,581 | 10/1993 | Miki et al. | 101/121 |
| 5,285,725 | 2/1994 | Imamaki et al. | 101/127.1 |
| 5,303,647 | 4/1994 | Seo et al. | 101/125 |

FOREIGN PATENT DOCUMENTS

| | | |
|---|---|---|
| 0534699 | 3/1993 | European Pat. Off. . |
| 0553999 | 8/1993 | European Pat. Off. . |
| 5-93846 | 4/1993 | Japan . |

*Primary Examiner*—Edgar S. Burr
*Assistant Examiner*—Lynn D. Hendrickson
*Attorney, Agent, or Firm*—Oliff & Berridge

[57] ABSTRACT

A stencil plate includes ink-permeated foam permeated with ink, the ink-permeated foam having a periphery; a heat-sensitive wrapping made from a thermoplastic film and a porous support adhered to each other, the thermoplastic film forming a thermoplastic film side of the heat-sensitive wrapping and the porous support forming porous support side of heat-sensitive wrapping, the heat-sensitive wrapping surrounding the ink-permeated foam so that the heat-sensitive wrapping covers the periphery of the ink-permeated foam with its porous support side in confrontation with the ink-permeated foam; and an ink-impermeable base material adhered by an adhesive to the thermoplastic film side of the heat-sensitive wrapping.

11 Claims, 5 Drawing Sheets

PLATE FOR STENCIL PRINTING

BACKGROUND OF THE INVENTION

1. Field of the Invention

The present invention relates to a plate for stencil printing, that is, forming an image on a paper or other surface by forcing ink through perforations of a stencil image that is formed in a stencil paper, and further relates to the structure of the plate for stencil printing.

2. Description of the Related Art

The present inventor described a stamp-producing device in Japanese Patent Application Kokai No. HEI-5-93846. The stamp-producing device is for forming stencil images on a stencil plate fed into the device. The stencil plate includes a frame, an ink-permeated body, heat-sensitive stencil paper, and film. An opening is formed in the frame having substantially the same shape as the ink-permeated body. For example, when the ink-permeated body has a planer rectangular shape, the opening also has a planer rectangular shape. The ink-permeated body is fitted to the interior of the opening and sandwiched between the film and the heat-sensitive stencil paper. That is, the film, a base material that is impermeable to the ink, is adhered by adhesive to one side of the frame so as to cover the opening and the ink-permeated body on one side. The heat-sensitive stencil paper is adhered by adhesive to the other side of the frame so as to cover the opening and the ink-permeated body on the other side.

The stencil plate is inserted into the stamp-producing device where a stencil image is formed in the stencil paper by a perforation means, such as a thermal head provided in the stencil producing device, based on image data of desired character strings, symbols, figures, and the like. The stencil plate formed with the stencil image is attached to the lower surface of a portable stamp block. Images of the desired character strings, symbols, figures, and the like are stamped on the surface of papers or products using the portable stamp block and the stencil plate.

However, stencil producing device with the above configuration has the following problems. When stamping using the stamp block, ink from the ink-permeated body can contact the adhesive layers that adheres the ink-impermeable film and the stencil paper to the frame. The ink permeates the adhesive to an extent that varies with the type of solvent in the ink. The adhering capability of the adhesive drops as a result so that the film and the heat-sensitive stencil paper peel away from the frame. A great deal of ink can leak from gaps that open between the film and the frame, and the heat-sensitive stencil paper and the frame, thereby undesirably staining the stamp surface.

The ink can also chemically react with the adhesive so that the characteristics of the ink change. This adversely effects print quality. Further, because the ink-permeated body directly contacts the frame when installed in the opening of the frame, the solvent of the ink might degrade the synthetic resin of the frame and cause cracks to form in the frame. Conventionally, the combination of materials forming the ink, the adhesive, and the frame must be taken into consideration to avoid these problems. This greatly limits the materials that can be used, thereby increasing costs.

SUMMARY OF THE INVENTION

It is an objective of the present invention to solve the above-described problems and provide a plate for stencil printing that is not affected by the ink solvent in the ink, wherein inexpensive adhesive and frame materials can be used, and whereby quality of printing can be stably maintained.

In order to achieve the above-described objectives, a stencil plate according to the present invention includes an ink-permeated body permeated with ink, the ink-permeated body having a periphery; a heat-sensitive wrapping made from a thermoplastic film and a porous support adhered to each other, the thermoplastic film forming a thermoplastic film side of the heat-sensitive wrapping and the porous support forming porous support side of heat-sensitive wrapping, the heat-sensitive wrapping surrounding the ink-permeated body so that the heat-sensitive wrapping covers the periphery of the ink-permeated body with its porous support side in confrontation with the ink-permeated body and an ink-impermeable base material adhered by an adhesive to the thermoplastic film side of the heat-sensitive wrapping.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
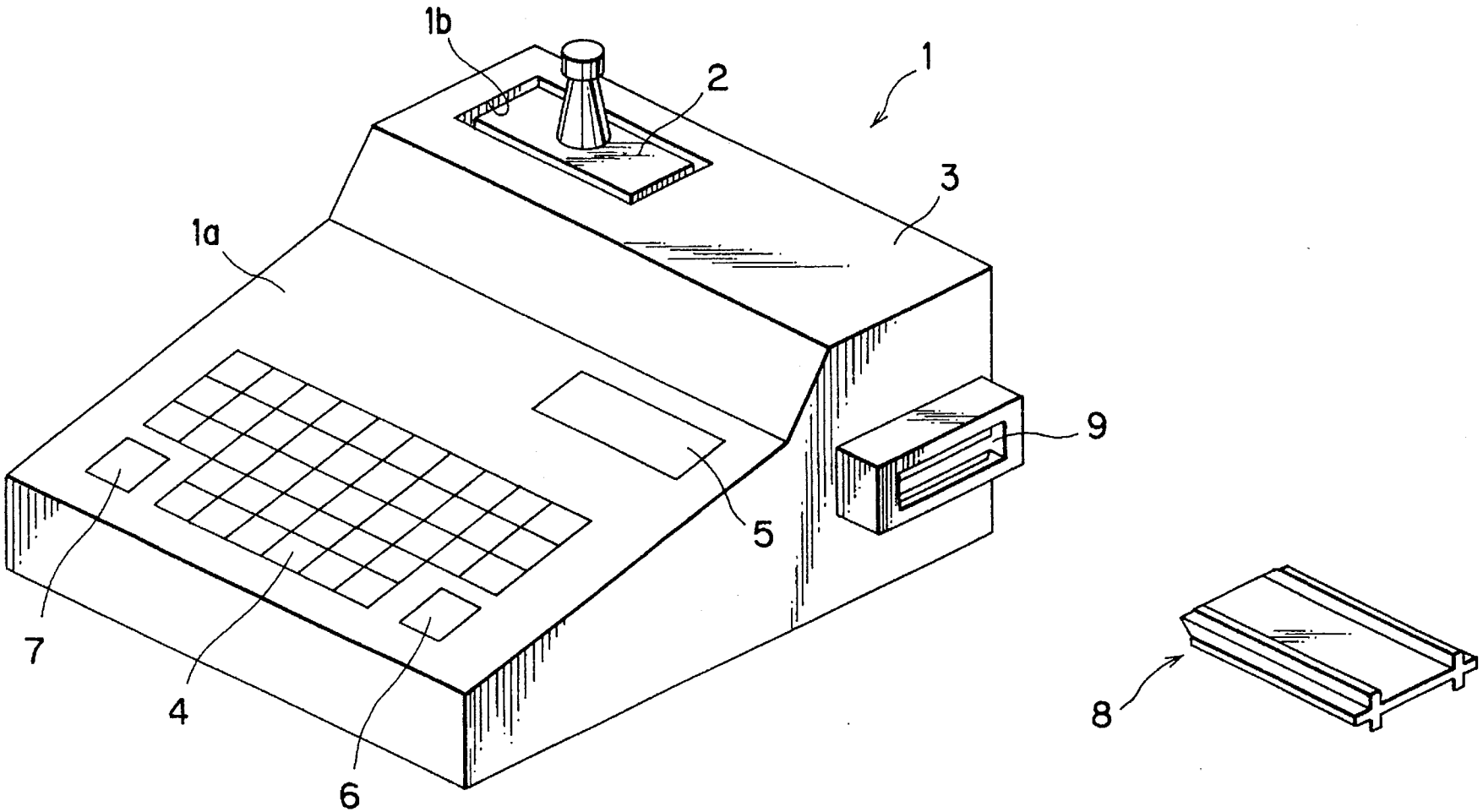
FIG. 1 is a perspective view showing a stamp producing unit in which a stencil plate according to the present invention may be used.

A plate for stencil printing according to preferred embodiments of the present invention will be described while referring to the accompanying drawings wherein like parts and components are designated by the same reference numerals to avoid duplicating description.

As shown in FIG. 1, the stencil-producing unit 1 includes a two-step shaped case 3. A receiving portion 1*b* for receiving a stamp block 2 is formed in the uppermost step of the case 3. The stamp block 2 is freely removable from the receiving portion 1*b*. An operation portion 1*a* is provided on the lower step of the case 3. The operation portion 1*a* is for inputting characters, symbols, figures, and the like. The operation portion 1*a* is provided with a keyboard 4; a display 5 such as a liquid crystal display; a stencil-production execution key 6; a power switch 7; and the like. A reading portion (not shown) is provided for reading a recording medium, such as a ROM card, inserted therein for inputting specific images such as figures. A RAM (not shown) is provided for storing the inputted image data.

A microcomputer (not shown) is provided for sending a command to a thermal head drive circuit (not shown) for driving a thermal head 23 connected thereto. To produce a stencil, in a manner that will be described later, the thermal head drive circuit transmits a signal of the image data to the thermal head 23 upon receiving a command from the microcomputer.

An insertion port 9 for inserting a stencil plate 8 (to be described later) is opened in the side of the case 3. The insertion port 9 leads to a transport path 10 at the interior of the stamp-producing unit 1.

Figure 2:
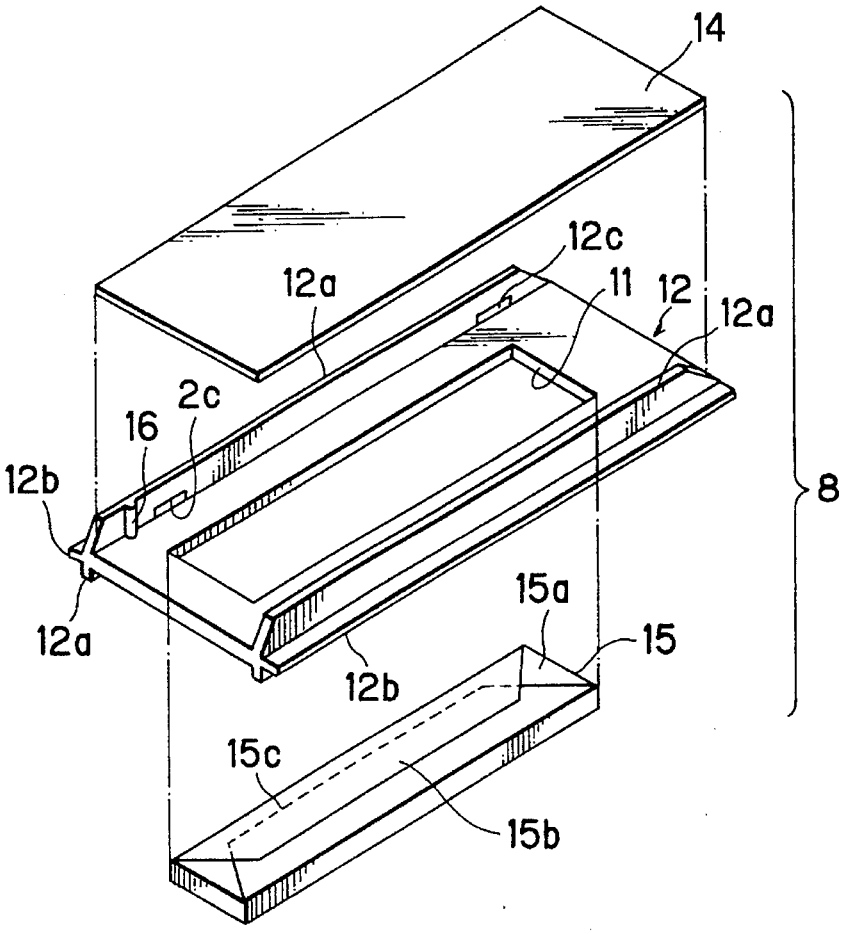
FIG. 2 is an exploded view showing a stencil plate according to a first preferred embodiment of the present invention.
Figure 3:
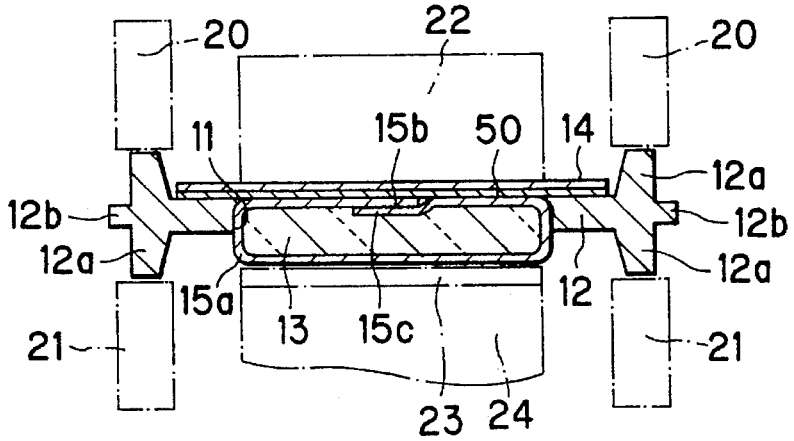
FIG. 3 is a cross-sectional view taken along the line III—III of FIG. 5.

As shown in FIGS. 2 and 3, the stencil plate 8 according to the first preferred embodiment of the present invention includes a film 14, a frame 12, and a wrapped body 15. The film 14 is an ink-impermeable base material. The frame 12 is formed from a synthetic resin and has an opening 11 formed therein that is a substantially rectangular shape. The wrapped body 15 includes an ink-permeated body 13; and a wrapping 15*a* formed from a heat-sensitive stencil paper that wraps the entire periphery of the ink-permeated body 13. The wrapped body 15 is fitted in the interior of the opening 11 in the frame 12 so that its upper surface (as shown in FIGS. 2 and 3) is aligned with the upper surface (as shown in FIGS. 2 and 3) of the frame 12. The film 14 is fixedly adhered to the aligned surfaces of the wrapped body 15 and the frame 12 by a coating of adhesive 50 thereby fixing the wrapped body 15 in the opening 11.

The wrapping 15*a* is made from a rectangular shaped sheet of heat-sensitive stencil paper. The heat-sensitive stencil paper is formed from a 1 to 4 micron thick thermoplastic film adhered to a stencil support. The thermoplastic film is made from, for example, a polyethylene terephthalate (PET) film, polypropylene, or a copolymer of vinylidene chloride and vinyl chloride. The stencil support is made from Japanese paper (washi) or an unwoven cloth. Japanese paper can be fashioned from, for example, a natural fiber such as hemp, paper mulberry (*Broussonetia kazinoki*), or mitsumata (*Edgeworthia papyrifera*). The unwoven cloth can be made from, for example, a synthetic fiber such as rayon. In the first preferred embodiment, the wrapping 15*a* is folded around the ink-permeated body 13 with the stencil support facing inward so that only the stencil support is in contact with the ink-permeated body 13. Folding the upper and lower flaps 15*b* and 15*c* one on top of the other as shown in FIG. 2 envelops the ink-permeated body 12 completely within the wrapping 15*a*. The wrapped body 15 is adhered to the film 14 by the adhesive 50 being applied to the outer surface, i.e., the surface formed from thermoplastic film, of the upper flap 15*b*.

Rail-shaped vertical members 12*a* are integrally formed to the lengthwise sides (i.e., the sides shown in cross section to the left and right in FIG. 3) of the frame 12 so as to protrude upward and downward. Further, a horizontal guide rail 12*b* is integrally formed to the outer surface of each vertical member 12*a*. A protruding engagement portion 16, formed in a substantially triangular shape when viewed in cross section, is integrally formed to one side of the inner surface of one of the vertical member 12*a* at a position on the frame 12 downstream in the transport direction A (labeled by the arrow A in FIG. 5). An engagement groove 12*c* is provided for engaging the stencil plate 8 to the lower surface of the stamp block 2.

Figure 4:
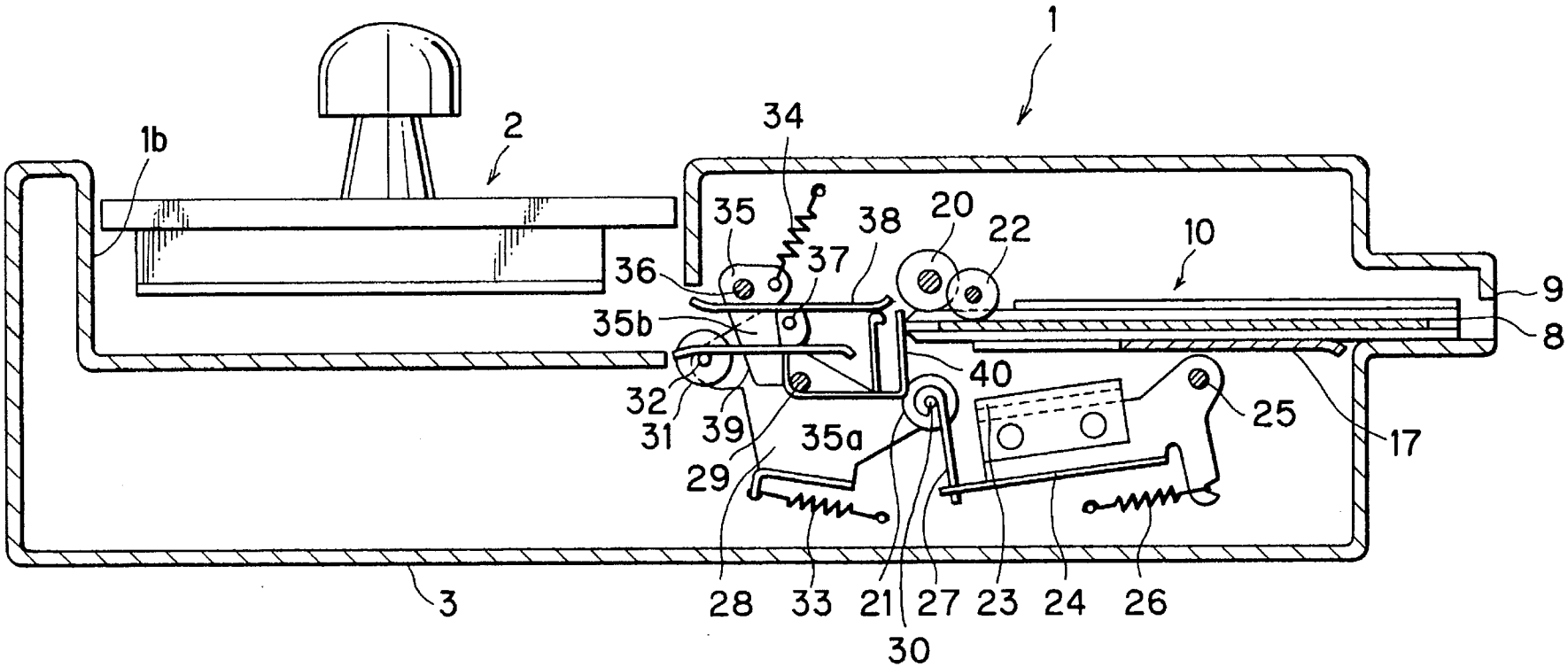
FIG. 4 is a cross-sectional view showing the stamp producing unit shown in FIG. 1 with the stencil plate shown in FIG. 2 inserted therein.
Figure 5:
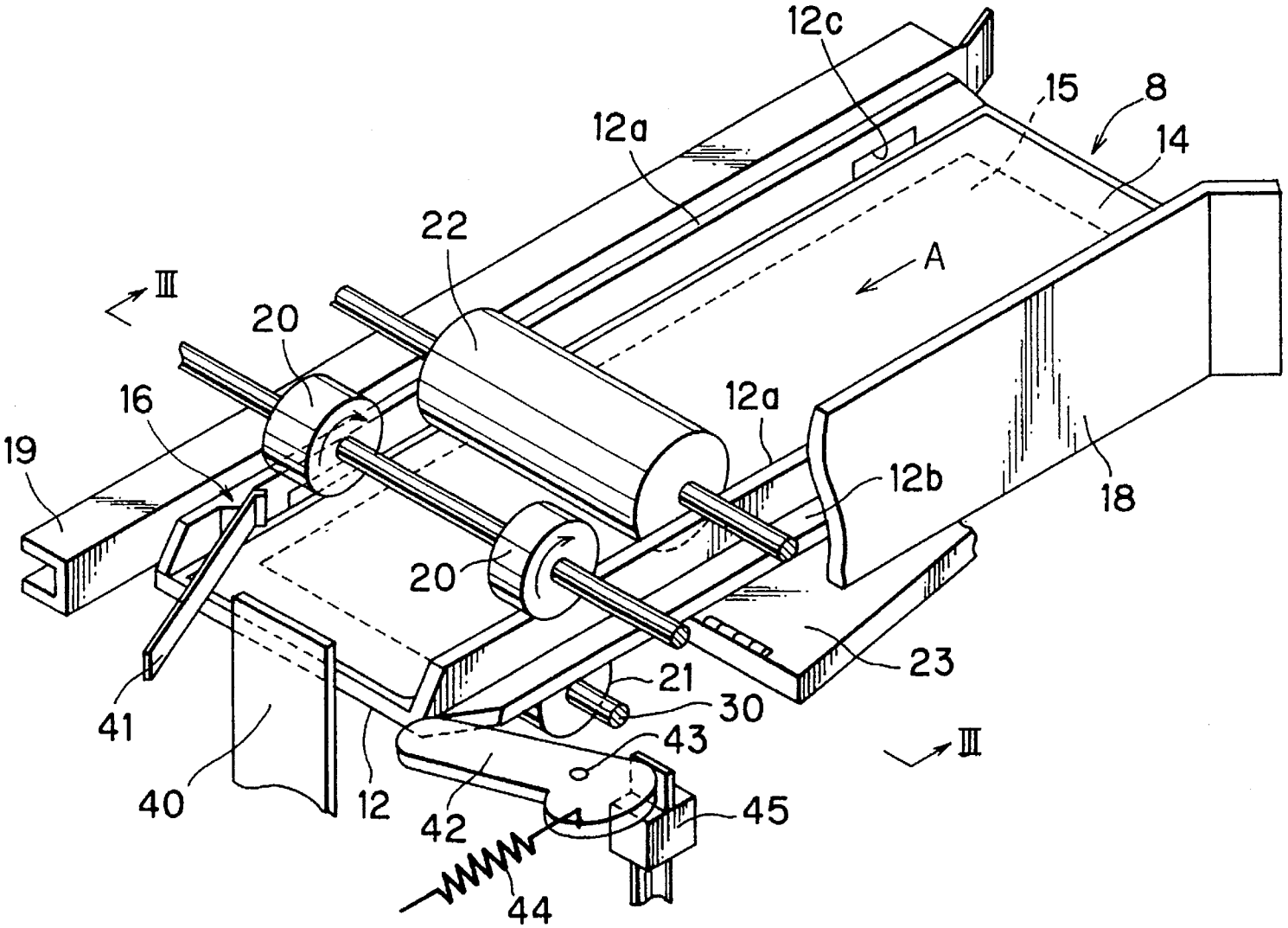
FIG. 5 is perspective view showing the stencil plate shown in FIG. 2 in a transport path of the stamp producing unit.

Next, an explanation of the structure of the transport path 10 and the stamp-producing unit 1 will be provided while referring to FIGS. 3, 4, and 5. As shown in FIGS. 4 and 5, the transport path 10 is defined by a lower guide plate 17, for supporting the lower surface of the stencil plate 8, and left and right side guide plates 18 and 19 for guiding the left and right sides of the stencil plate 8. The position of the guide plate 18 is fixed. The guide plate 19 is urged by a spring so as to be movable so as to abut the outer surface of the other guide rail 12*b* of the stencil plate.

Feed rollers 20 and a sandwiching roller 21 for abutting the upper and lower surfaces respectively of the vertical members 12*a* are arranged in vertical opposition near a center portion of the transport path 10. The feed rollers 20 are rotated in the clockwise direction in FIG. 5 by a motor (not shown) to transport the stencil plate 8 in the transport direction A. A platen 22 is provided to the interior of the transport path 10 so as to fit between the upwardly protruding portions of the vertical members 12*a* of a frame 12 in the transport path 10. The platen 22 therefore abuts the ink-impermeable film 14 of a stencil plate 8 being transported through the transport path 10.

A thermal head support plate 24 is supported on a shaft 25 below the lower guide plate 17 so as to freely swing upward and downward. A thermal head 23 is attached to the thermal head support plate 24. A pulling spring 26 is provided with one of its ends attached to the head support plate 24 so as to urge the head support plate 24 in the clockwise direction shown in FIG. 4. The thermal head support plate 24 is operated by a cam mechanism (not shown) so as to swing between a perforation position, wherein the thermal head 23 confronts the platen 22 with the stencil plate 8 sandwiched therebetween so that the thermal head 23 contacts the lower surface of the wrapping member 15*a* of the wrapped body 15 of the stencil plate 8 in the transport path 10, and a standby position, wherein the thermal head support plate 24 is separated downward from the lower surface of the wrapping 15*a*.

A pair of support plates 28 for supporting the sandwiching roller 21 are supported on a shaft 29 so as to be movable in a seesaw movement with the shaft 29 as the axis. A connection wire 27 connects the thermal head support plate 24 to the sandwiching roller 21 so that the thermal head support plate 24 and the support plates 28 move in association. An end of the connection wire 27 is wrapped around the support shaft 30 so that support shaft 30, and consequently the sandwiching roller 21, is supported freely rotatable thereon. A discharge roller 31 is supported on a shaft 32 to the downstream side (in regards to the transport path) of the support plates 28 so that the shaft 29 is between the discharge roller 31 and the sandwiching roller 21. One of a pair of pulling springs 33 (only one of which is shown in FIG. 4) is attached to each support plate 28. The pulling springs 33 urge the support plates 28 in the counter-clockwise direction, as shown in FIG. 2, around the shaft 29 which acts as an axis.

A stop frame 35 is arranged in between the support plates 28 so as to be swingable on a shaft 36. A gate 40 is provided to a tip of the stop frame 35 so as to protrude upward. A pulling spring 34 is attached to the stop frame 35 for urging the gate 40 into the transport path 10 and into a confrontation with the tip of a stencil plate 8 in the transport path 10. One of a pair of operation pins 37 is provided to the interior surface of each support plate 28 so that the operation pins 37 protrude inward in confrontation with each other. When the support plates 28 are rotated on the shaft 29 in the counter-clockwise direction of FIG. 4, the operation pins 37 abut the substantially vertically extending neck portion 35*b* of the stop frame 35. The stop frame 35 is pressed by the operation pin 37 and is rotated in the clockwise direction of FIG. 4 so that the gate 40 moves downward and allows passage of the stencil plate 8. Upper and lower guide plates 38 and 39 are arranged between the feed roller 20 and the stamp block 2 in the receiving portion 1*b*. A stopper arm 35*a* is provided integrally with the stop frame 35 so as to extend upward from the stop frame 35. The stopper arm 35*a* is provided so as to abut the lower surface of the upper guide plate 38 when the stop frame 35 rotates in the counter-clockwise direction of FIG. 4, thereby limiting the rotation of the stop frame 35 and setting the position of the gate 40.

As mentioned above, an engagement portion 16 is provided to the interior surface of the vertical member 12*a* at the side of the frame 12 near the movable guide plate 19. As shown in FIG. 5, a plate spring 41 is provided for setting a correct posture to the stencil plate 8 for a stencil production starting position (wherein the tip of the stencil plate 8 abuts the gate 40). When the stencil plate 8 is inserted with the correct posture to the interior of the transport path 10, i.e., so that its upper surface faces upward, its lower surface faces downward, and its front tip end confronts the gate 40, the engagement portion 16 is positioned at the downstream side of the frame 12 in regards to the transport direction A. In this case, the tip of the plate spring 41 can engage the engagement portion 16 with a click.

On the other hand, a push-back lever 42 for pushing the stencil plate 8 back in the upstream direction of the transport direction A is provided in the transport path 10. The push-back lever 42 is provided rotatable in the horizontal direction on a shaft 43, which acts as an axis, so that the front tip of the push-back lever 42 protrudes into the transport path 10. A pulling spring 44 is provided with one of its ends attached to the push-back lever 42 for urging the push-back lever 42 to push the stencil plate 8 back upstream relative to the transport direction A. The engagement force at which the plate spring 41 engages with the engagement portion 16 is set weaker than the pushing force at which the pulling spring 44 pulls the push-back lever 42. When the plate spring 41 is engaged with the engagement portion 16, the push-back lever 42 is rotated a predetermined angle. This condition is sensed by a sensor 45 to show that the stencil plate 8 is inserted in the correct posture. In this way, that the stencil production starting position is set is detected (refer to FIG. 5).

To produce a stencil with this mechanism, image data such as predetermined characters are inputted via the keyboard 4. Then a stencil plate 8 is inserted into the transport path 10 through the insertion port 9 and the stencil-production execution key 6 is depressed. By this, a control device, such as a microcomputer (not shown) in the stamp producing device, receives a signal from the sensor 45 indicating whether the insertion posture of the stencil plate 8 is correct or whether the stencil plate 8 has been inserted as described above. When the insertion posture is correct, the gate 40 lowers and the thermal head 23 abuts the heat-sensitive stencil paper, i.e., the lower surface of the wrapped body 15, at the lower surface of the stencil plate 8. The thermal head 23 is energized by a signal that corresponds to the desired image data. Simultaneously, the feed roller 20 drives the stencil plate 8 downstream in the transport direction A at a predetermined speed. Therefore, a predetermined aperture image is formed in the heat-sensitive stencil paper. In this way, a stencil can be produced. The stencil plate 8 with the aperture image (which is a mirror image) formed therein is discharged into the receiving portion 1*b*. Therefore, by depressing the stamp block 2, the stencil plate 8 is mounted to the lower surface of the stamp block 2 by a predetermined mechanism. By removing the stamp block 2 from the receiving portion 1*b* and pressing it on a paper surface and the like, an image (stamp) of a predetermined character string and the like can be stamped on the paper surface.

On the other hand, when the frame 12 of the stencil plate 8 is inserted backwards (i.e., when the engagement portion 16 is positioned on the upstream side of the transport path) or upside down into the transport path 10, the engagement portion 16 will not engage with the plate spring 16 at the position where the front edge of the stencil plate 8 abuts the gate 40. Accordingly, the pushing force from the push-back lever 42 will push the stencil plate 8 back upstream along the transport path. In such a case, the predetermined signal from the sensor will not be generated. Therefore, when the insertion posture is determined as incorrect, or when the stencil plate 8 is not inserted, stencil production can not be executed even if the stencil-production execution key 6 is depressed. An indication the insertion is incorrect, or that the stencil plate 8 has not been inserted, is displayed on the display 5.

Figure 6:
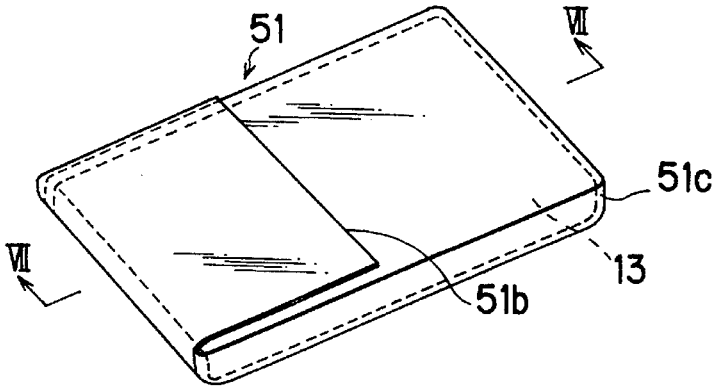
FIG. 6 is a perspective view showing a wrapped body according to a second preferred embodiment of the present invention.
Figure 7:
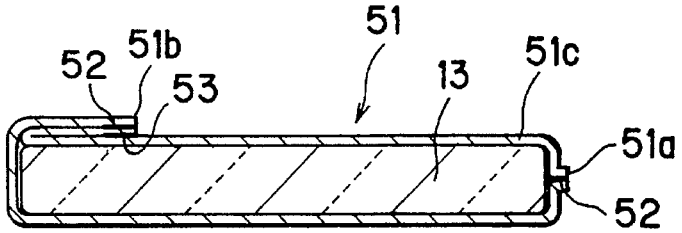
FIG. 7 is a cross-sectional view taken along the line VII—VII of FIG. 6.

FIGS. 6 and 7 indicate a wrapped body 51 according to a second preferred embodiment. In the second preferred embodiment, a wrapping 51*c* (made from heat-sensitive stencil paper as in the first preferred embodiment) is formed in an appropriate length to a tubular shape with open ends 51*a* and 51*b* at either ends of the tube. The open end 51*a* is adhered shut at its inner surface beforehand by an adhesive 52 that is impermeable to the ink filling the ink-permeated body 13. The ink-permeated body 13 is inserted through the other open edge 51*b*. The ink-permeated body 13 is permeated with ink before or after being inserted into the tube. The other open edge 51*b* is then closed shut by coating the same adhesive 52 to its inner surface. A flap at the open end 51*b* is folded upward and fixed in place to the outer surface of the wrapping 51*c* (i.e., the surface formed from the thermoplastic film) using the same or a different adhesive 53 so that it does not lift away from the wrapping 51*c*.

Figure 8:
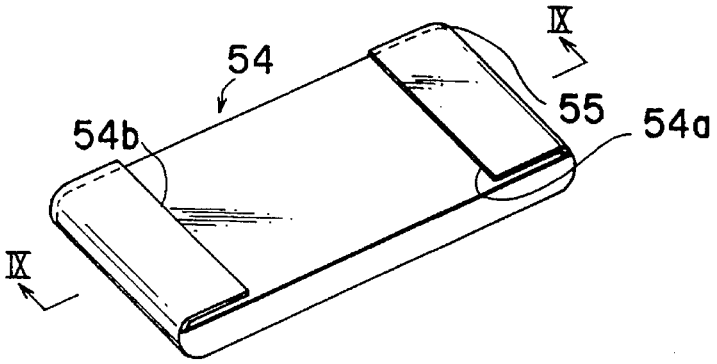
FIG. 8 is a perspective view showing a wrapped body according to a third preferred embodiment of the present invention.
Figure 9:
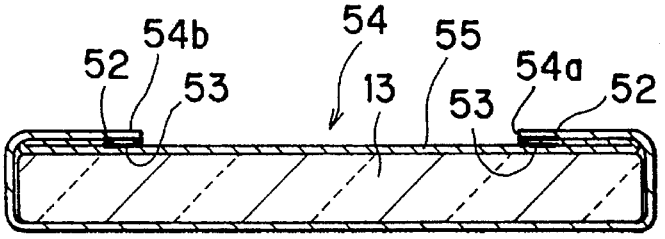
FIG. 9 is a cross-sectional view taken along the line IX—IX of FIG. 8.

FIGS. 8 and 9 show a wrapped body 54 according to a third preferred embodiment of the present invention. The wrapped body 54 is made from a wrapping 55, formed from heat-sensitive stencil paper in a tubular shape with both ends 54*a* and 54*b* of the tubular shape open, and an ink-permeated body 13 permeated with ink. The ink-permeated body 13 is inserted into one of the ends 54*a* or 54*b*. Afterward, the inner surfaces of both the open ends 54*a* and 54*b* are adhered shut by an adhesive that is impermeable to the ink. Afterward, flaps are formed by folding the ends of the tube near both open ends 54*a* and 54*b* back and upward and fixing the flaps in place by the same or a different adhesive 53 so the flaps do not lift up. The wrapping bodies 51 and 54 of the second and third preferred embodiments are formed so that the stencil support portion of the heat-sensitive paper is positioned to the interior and in contact with the ink-permeated body 13.

The wrapped bodies 12, 51, and 54 formed from heat-sensitive stencil paper completely wrap the entire periphery of the ink-permeated body 13. The outer surface of a wrapping bodies 12, 51, or 54 is adhered to the lower surface of the film 14 (ink non-permeable base material) by adhesive 50. Therefore, the ink contained in the ink-permeated body 13 does not directly contact the opening portion of the frame 12 or the adhesive 50 at the lower surface of the film 14. Accordingly, the solvent in the ink does not permeate the adhesive 50 or the frame 12.

With a plate according to the present invention for stencil printing, the adhesive on the ink-impermeable base material and the solvent in the ink do not come into direct contact. Consequently, the adhering capability of the adhesive is not adversely affected and the ink-impermeable base material and the wrapped body do not peel away from the frame so that the ink does not leak through spaces between the frame and the ink-impermeable base material and the wrapped body. Also, because the ink and the adhesive do not come into contact, the ink does not chemically react with the adhesive and the characteristics of the ink remain stable.

According to the present invention, direct contact between the ink, which contains solvent, and the adhesive and the frame can be avoided. Because of this, the ink in the wrapped body does not unnecessarily leak out and the stamp surface is not stained. Also the solvent in the ink can not permeate the frame or the adhesive so that fewer limitations are placed on materials for the ink, the adhesive, and the frame. Not only can quality of stamps be stabilized, but production costs of the plate for stencil printing can be reduced.

While the invention has been described in detail with reference to specific preferred embodiments thereof, it would be apparent to those skilled in the art that various changes and modifications may be made therein without departing from the spirit of the invention.

What is claimed is:

1. A stencil plate for stencil printing, the stencil plate comprising:

an ink-permeated body permeated with ink, the ink-permeated body having a periphery;

a heat-sensitive wrapping made from a thermoplastic film and a porous support adhered to each other, the thermoplastic film forming a thermoplastic film side of the heat-sensitive wrapping and the porous support forming a porous support side of the heat-sensitive wrapping, the heat-sensitive wrapping surrounding the ink-permeated body so that the heat-sensitive wrapping covers the entire periphery of the ink-permeated body with its porous support side in confrontation with the ink-permeated body; and an ink-impermeable base material fixedly adhered by an adhesive to the thermoplastic film side of the heat-sensitive wrapping.

2. A stencil plate for stencil printing, comprising:

an ink-permeated body permeated with ink, the ink-permeated body having a periphery;

a heat-sensitive wrapping made from a thermoplastic film and a porous support adhered to each other, the thermoplastic film forming a thermoplastic film side of the heat-sensitive wrapping and the porous support forming a porous support side of the heat-sensitive wrapping, the heat-sensitive wrapping surrounding the ink-permeated body so that the heat-sensitive wrapping covers the periphery of the ink-permeated body with its porous support side in confrontation with the ink-permeated body; and an ink-impermeable base material adhered by an adhesive to the thermoplastic film side of the heat-sensitive wrapping, wherein the heat-sensitive wrapping is a substantially rectangular sheet with two widthwise edges and two lengthwise edges, the widthwise edges being folded around the ink-permeated body into widthwise flaps and the lengthwise edges being folded around the ink-permeated body into lengthwise flaps so that the widthwise flaps and the lengthwise flaps are sandwiched between the ink-permeated body and the ink-impermeable base material.

3. The stencil plate as claimed in claim 2, further comprising a frame formed with an opening, the opening being formed to a shape that substantially corresponds to a shape of the ink-permeated body surrounded by the heat-sensitive wrapping, the ink-permeated body surrounded by the heat-sensitive wrapping being fitted in the opening, the ink-impermeable base material being adhered to a surface of the frame.

4. The stencil plate as claimed in claim 3, wherein a surface of at least one of the lengthwise flaps is adhered to the ink-impermeable base material.

5. The stencil plate as claimed in claim 2, wherein the lengthwise flaps are folded around the ink-permeated body so as to at least partially overlap the widthwise flaps and at least partially overlap each other.

6. The stencil plate as claimed in claim 2, wherein the widthwise flaps are folded around the ink-permeated body so as to at least partially overlap each other.

7. A stencil plate for stencil printing, comprising:

an ink-permeated body permeated with ink, the ink-permeated body having a periphery;

a heat-sensitive wrapping made from a thermoplastic film and a porous support adhered to each other, the thermoplastic film forming a thermoplastic film side of the heat-sensitive wrapping and the porous support forming a porous support side of the heat-sensitive wrapping, the heat-sensitive wrapping surrounding the ink-permeated body so that the heat-sensitive wrapping covers the periphery of the ink-permeated body with its porous support side in confrontation with the ink-permeated body; and an ink-impermeable base material adhered by an adhesive to the thermoplastic film side of the heat-sensitive wrapping, wherein the heat-sensitive wrapping is a substantially tubular shape with an end having an interior surface and another end having another interior surface, the interior surface defining an opening and the another interior surface defining another opening, the end being sealed by a coat of an adhesive at the interior surface, the another end being sealed by a coat of the adhesive at the another interior surface, the end being folded into a flap, the thermoplastic film of the flap being adhered to the thermoplastic film at an area between the end and the another end so that the flap is sandwiched between the ink-impermeable base material and the ink-permeated body.

8. The stencil plate as claimed in claim 7, further comprising a frame formed with an opening, the opening being formed to a shape that substantially corresponds to a shape of the ink-permeated body surrounded by the heat-sensitive wrapping, the ink-permeated body surrounded by the heat-sensitive wrapping being fitted in the opening, the ink-impermeable base material being adhered to a surface of the frame.

9. The stencil plate as claimed in claim 7, wherein the another end is folded into another flap and wherein the thermoplastic film of the another flap is adhered to the thermoplastic film at another area between the end and the another end so that the another flap is sandwiched between the ink-impermeable base material and the ink-permeated body.

10. The stencil plate as claimed in claim 9, further comprising a frame formed with an opening, the opening being formed to a shape that substantially corresponds to a shape of the ink-permeated body surrounded by the heat-sensitive wrapping, the ink-permeated body surrounded by the heat-sensitive wrapping being fitted in the opening, the ink-impermeable base material being adhered to a surface of the frame.

11. A stencil plate for stencil printing, comprising:

an ink-permeated body permeated with ink, the ink-permeated body having a periphery;

a heat-sensitive wrapping made from a thermoplastic film and a porous support adhered to each other, the thermoplastic film forming a thermoplastic film side of the heat-sensitive wrapping and the porous support forming a porous support side of the heat-sensitive wrapping, the heat-sensitive wrapping retaining the ink-permeated body so that the heat-sensitive wrapping covers the entire periphery of the ink-permeated body with its porous support side in confrontation with the ink-permeated body; and an ink-impermeable base material in contact with the thermoplastic film side of the heat-sensitive wrapping.

* * * * *